US011824308B2

(12) United States Patent
Jung et al.

(10) Patent No.: US 11,824,308 B2
(45) Date of Patent: Nov. 21, 2023

(54) CONNECTOR ASSEMBLY HAVING A DEVICE FOR DUAL POSITION CONFIRMATION

(71) Applicants: HYUNDAI MOTOR COMPANY, Seoul (KR); KIA CORPORATION, Seoul (KR); KUM LLC, Ulsan (KR)

(72) Inventors: Yun Jae Jung, Suwon-si (KR); Chan Gu Yun, Gimhae-si (KR); Anbumani Neelamegam, Andimadam (IN)

(73) Assignees: HYUNDAI MOTOR COMPANY, Seoul (KR); KIA CORPORATION, Seoul (KR); KUM LLC, Ulsan (KR)

( * ) Notice: Subject to any disclaimer, the term of this patent is extended or adjusted under 35 U.S.C. 154(b) by 101 days.

(21) Appl. No.: 17/506,517

(22) Filed: Oct. 20, 2021

(65) Prior Publication Data

US 2022/0200203 A1 Jun. 23, 2022

(30) Foreign Application Priority Data

Dec. 22, 2020 (KR) ..... 10-2020-0180652

(51) Int. Cl.
*H01R 13/648* (2006.01)
*H01R 13/629* (2006.01)
*H01R 13/627* (2006.01)
*H01R 13/639* (2006.01)

(52) U.S. Cl.
CPC ... *H01R 13/62955* (2013.01); *H01R 13/6272* (2013.01); *H01R 13/639* (2013.01)

(58) Field of Classification Search
CPC ..... H01R 13/62955; H01R 13/6272
See application file for complete search history.

(56) References Cited

U.S. PATENT DOCUMENTS

| | | | | |
|---|---|---|---|---|
| 7,175,451 | B2 * | 2/2007 | Shuey | H01R 13/641 439/157 |
| 9,413,108 | B2 * | 8/2016 | Iwatani | H01R 13/62938 |
| 9,425,554 | B2 * | 8/2016 | Iwatani | H01R 13/641 |
| 9,831,601 | B2 | 11/2017 | Kim | |
| 10,910,765 | B2 * | 2/2021 | Ochiai | H01R 13/62977 |
| 2005/0221648 | A1 * | 10/2005 | Deno | H01R 13/62955 439/157 |
| 2006/0211286 | A1 | 9/2006 | Shuey | |
| 2017/0077646 | A1 | 3/2017 | Kim | |
| 2022/0209469 | A1 * | 6/2022 | Jung | H01R 13/707 |

FOREIGN PATENT DOCUMENTS

| | | | |
|---|---|---|---|
| KR | 20070100929 | A | 10/2007 |
| KR | 20170033081 | A | 3/2017 |

* cited by examiner

*Primary Examiner* — Neil Abrams
(74) *Attorney, Agent, or Firm* — LEMPIA SUMMERFIELD KATZ LLC

(57) ABSTRACT

A connector assembly has a device for dual position confirmation and is able to accurately show whether female and male connectors have been completely connected to each other at an appropriate position by a lever using the device for dual position confirmation and also to show the connected state and position of the lever. Rotation of the lever draws the connectors together so that, upon complete mating, a protrusion on the male connector causes release of a hook that retains the device whereby the device becomes tilted to indicate complete connection. The device is moved to a position in which it engages and fixes a handle of the lever.

10 Claims, 8 Drawing Sheets

CONNECTOR ASSEMBLY HAVING A DEVICE FOR DUAL POSITION CONFIRMATION

CROSS REFERENCE TO RELATED APPLICATION

The present application claims priority to Korean Patent Application No. 10-2020-0180652, filed on Dec. 22, 2020, the entire contents of which are incorporated herein for all purposes by this reference.

BACKGROUND

Field of the Disclosure

The present disclosure relates to a connector assembly having a device for dual position confirmation and, more particularly, to a connector assembly having a device for dual position confirmation, the connector assembly being able to show the fastened state of female and male connectors by a lever and the fastened state of the lever.

Description of the Related Art

In general, connector assemblies for electrical connection are used for electric and electronic parts of a vehicle.

A connector assembly according to an example of the related art includes a female connector, a male connector, a device for CPA (Connector Position Assurance) for checking whether the female connector and the male connector have been completely fastened to each other, and the like.

Accordingly, when the female connector and the male connector of the connector assembly according to an example of the related art are fastened to each other, it is possible to recognize the fastened state and position of the female and male connectors using the device for connector position assurance.

A connector assembly according to another example of the related art includes a female connector, a male connector, a lever rotating along an operation path for fastening the female and male connectors, a device for lever position assurance that is fastened to the lever after the lever is rotated, and the like.

Accordingly, it is possible to recognize that the lever is at the position where the lever fastens the female and male connectors by fastening the female and male connectors to each other by rotating the lever along the operation path and then fastening the device for lever position assurance to the rotated lever.

However, even though it is possible to recognize that the lever is at the position where the lever fastens the female and male connectors to each other, it is difficult to accurately recognize whether the female and male connectors have been completely fastened to each other.

The foregoing is intended merely to aid in understanding the background of the present disclosure, and is not intended to mean that the present disclosure falls within the purview of the related art that is already known to those having ordinary skill in the art.

SUMMARY

In order to solve the problems of the related art described above, an objective of the present disclosure is to provide a connector assembly having a device for dual position confirmation. The disclosed connector assembly is able to not only accurately show whether female and male connectors have been completely fastened to each other at an appropriate position by a lever using the device for dual position confirmation, but to also show the fastened state and position of the lever.

In order to achieve these objectives, the present disclosure provides a connector assembly having a device for dual position confirmation. The connector assembly includes: a male connector having a position confirmation protrusion formed at the front end of a top thereof and having guide pins protruding from both sides thereof; a female connector having a first guide hole on a top thereof in which the position confirmation protrusion is inserted to be able to move straight or linearly and having second guide holes on both sides thereof in which the guide pins are inserted to be able to move straight or linearly; a device for dual position confirmation fastened to a rail formed behind the first guide hole to be able to be tilted and moved straight or linearly; and a lever configured to move forward and backward the guide pins in the second guide holes. The lever has rotary levers fastened to both sides of the female connector and a handle lever having a locking groove for fastening with the device for dual position confirmation and integrally formed with the rotary lever.

The device for dual position confirmation may include: a body configured to be pushed and moved straight; a hook formed on a bottom of a front portion of the body and configured to be locked to a rear wall of the first guide hole of the female connector to be able to move up; and a locking bar formed on a bottom of a rear portion of the body and configured to be separably inserted in the locking groove of the lever.

An empty space for absorbing push pressure may be formed in the body.

Step-shaped wrinkles may be formed forward and backward from a top of the body for easy operation for straight moving.

A lever cover end configured to move over and cover a front end portion of the handle lever may be formed at a rear portion of the body.

Slots may be formed at the rotary levers of the lever. The guide pins, which protrude through the second guide holes, are received in the slots and the slots may be curved to straightly move the guide pins in the second guide holes when the rotary levers are rotated.

When the position confirmation protrusion of the male connector is inserted up to the rear wall of the first guide hole and presses the hook with the hook of the device for dual position confirmation locked to the rear wall of the first guide hole of the female connector, the hook may be moved up and unlocked.

After the hook is moved up and unlocked, when the body of the device for dual position confirmation is pushed toward the lever, the locking bar may be inserted and locked in the locking groove of the lever.

When the locking bar is inserted into the locking groove of the lever, a lever cover end of the device for dual position confirmation may move over and cover a front end portion of the handle lever.

An insertion force when the locking bar is inserted into the locking groove of the lever may be set as 2.0 kgf or less.

The present disclosure provides the following effects through the objectives described above.

First, when the lever is operated and the female and male connectors are fastened to each other, a user can recognize that the female and male connectors have been completely fastened by seeing the hook of the device for dual position confirmation lifting.

Second, after the female and male connectors are completely fastened to each other, the user can recognize that the locking bar of the device for dual position confirmation has been inserted in the locking groove of the lever and that the lever has been firmly fixed at the position after rotation by seeing that the lever cover end of the device for dual position confirmation moves over and covers the front end portion of the lever by moving straight the device for dual position confirmation toward the lever.

Therefore, it is possible to dually check the fastening state and position of the female and male connectors and the fastening state and position of the lever by the device for dual position confirmation. Thus, it is possible to improve stability and quality of the connector assembly.

BRIEF DESCRIPTION OF THE DRAWINGS

The above and other objectives, features and other advantages of the present disclosure should be more clearly understood from the following detailed description when taken in conjunction with the accompanying drawings, in which.

DETAILED DESCRIPTION

Hereinafter, embodiments of the present disclosure are described in detail with reference to the accompanying drawings. When a component, device, element, or the like of the present disclosure is described as having a purpose or performing an operation, function, or the like, the component, device, or element should be considered herein as being "configured to" meet that purpose or to perform that operation or function.

Figure 1:
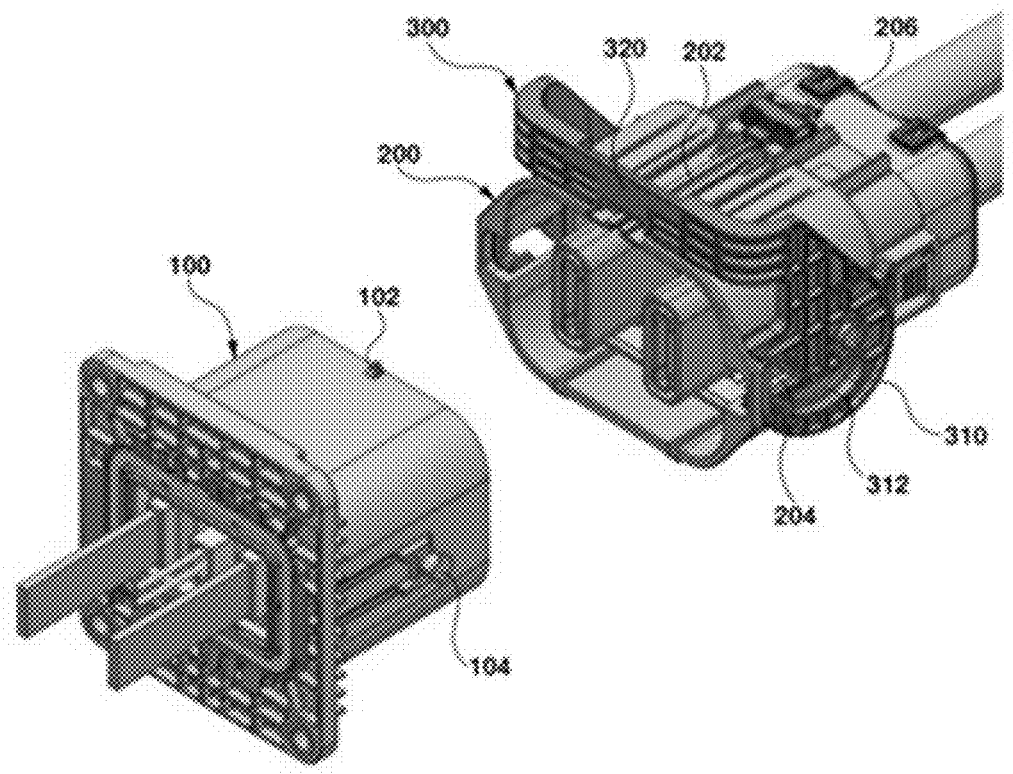
FIG. 1 is an exploded perspective view showing a connector assembly having a device for dual position confirmation according to the present disclosure.
Figure 2:
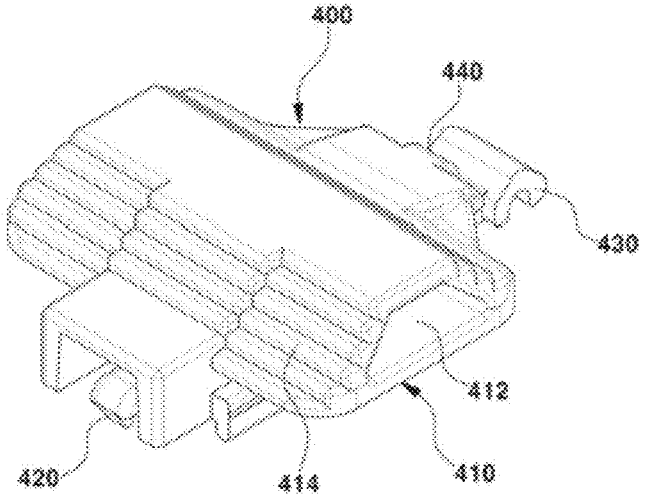
FIG. 2 is a perspective view showing the device for dual position confirmation according to the present disclosure.
Figure 3:
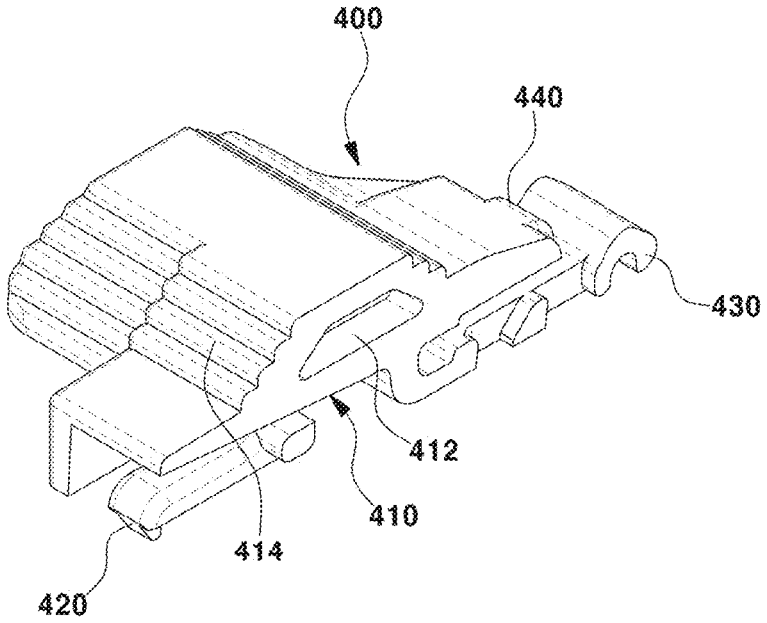
FIG. 3 is a partial cross-sectional view showing the device for dual position confirmation according to the present disclosure.
Figure 4:
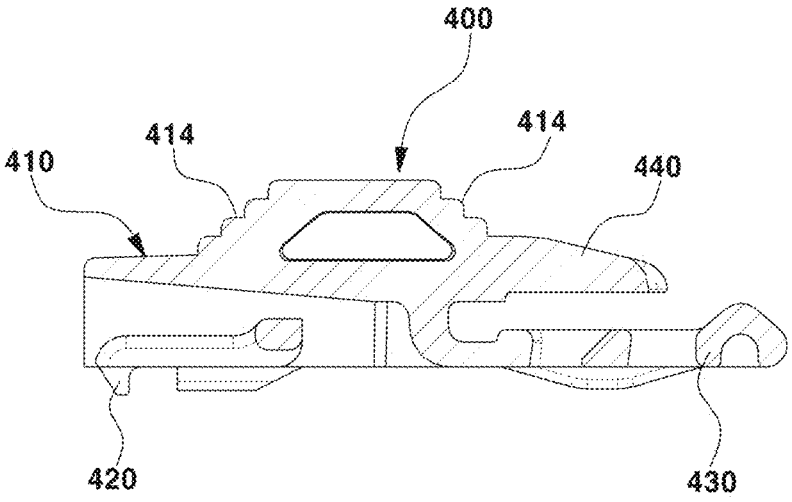
FIG. 4 is a cross-sectional view showing the device for dual position confirmation according to the present disclosure.

FIG. 1 is an exploded perspective view showing a connector assembly having a device for dual position confirmation according to the present disclosure. FIGS. 2-4 show the device for dual position confirmation according to the present disclosure.

As shown in FIG. 1, the connector assembly includes a male connector 100, a female connector 200, and a lever 300 for inserting the male connector 100 into the female connector 200 in order to electrically connect electric and electronic parts.

The male connector 100 has a position confirmation protrusion 102 formed at the front end of the top thereof and has guide pins 104 protruding from both sides.

The female connector 200 has a first guide hole 202 on the top in which the position confirmation protrusion 102 is inserted to be able to move straight or linearly. The female connector 200 also has second guide holes 204 on both sides in which the guide pins 104 are inserted to be able to move straight or linearly.

The lever 300 has a rotary lever 310 rotatably fastened to both sides of the female connector 200 and a handle lever 320 integrally formed with the rotary lever 310 and disposed in the width direction of the female connector 200.

The rotary lever 310 of the lever 300 is configured to move forward and backward the guide pins 104 of the male connector 100 in the second guide holes 204 of the female connector 200.

In more detail, in order to move the guide pins 104 forward and backward in the second guide holes 204, slots 312 are formed at the rotary levers 310. The guide pins 104 are inserted in the second guide holes 204 and protrude on both sides to be inserted or received in the slots. The slots 312 are curved to straightly or linearly move the guide pins 104 in the second guide holes 240 when the rotary levers 310 are rotated.

When the rotary levers 310 are rotated, the guide pins 104 are pushed or pulled by the curved slots 312. Thus, the guide pins 104 can easily move straight forward or backward in the second guide holes 204.

Figure 8:
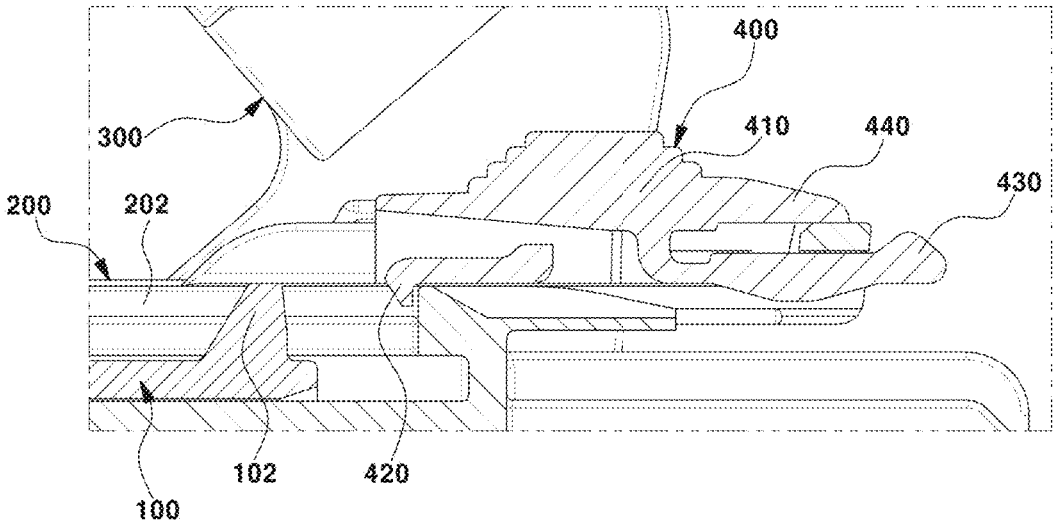
FIG. 8 is a cross-sectional view taken along line A-A shown in FIG. 5.
Figure 9:
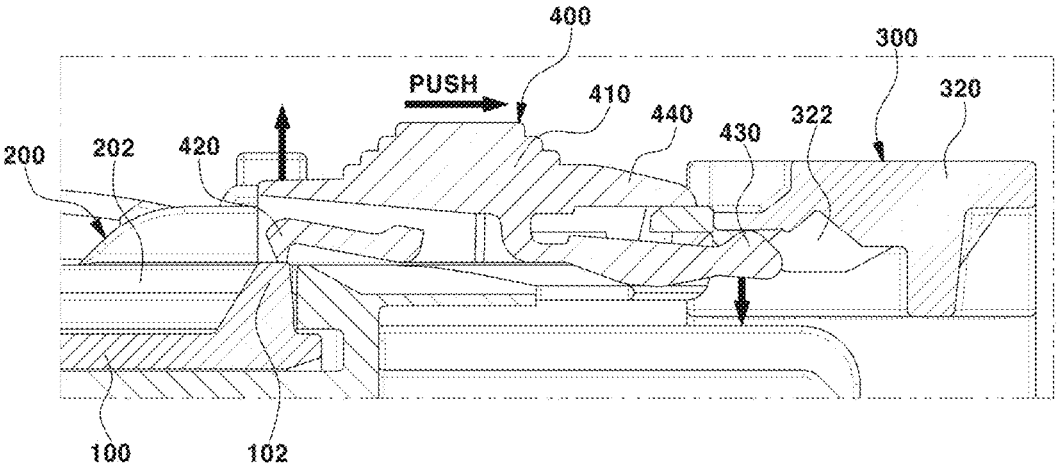
FIG. 9 is a cross-sectional view taken along line B-B shown in FIG. 6.

The handle lever 320 of the lever 300, as shown in FIGS. 8 and 9, has a locking groove 322 on the front for fastening with the device 400 for dual position confirmation and functions as a handle for rotating the rotary levers 310.

In particular, the device 400 for dual position confirmation is fastened to a rail 206 formed behind the first guide hole 202 to be able to be tilted and moved straight.

The device 400 for dual position confirmation, as shown in FIGS. 2-4, includes a body 410 that is pushed and moved straight by a user. The device 400 has a hook 420 that is integrally formed on the bottom of the front portion of the body 410 and that is locked to the rear wall of the first guide hole 202 of the female connector 200 to be able to move up. The device 400 also has a locking bar 430 that is integrally formed on the bottom of the rear portion of the body 410 and that is separably inserted in the locking groove 322 formed at the handle lever 320 of the lever 300.

An empty space 412 for absorbing push pressure by a user is formed in the body 410.

Step-shaped wrinkles 414 are formed forward and backward from the top of the body 410 so that a user can easily straightly move the device without slipping when operating the device.

A lever cover end 440 moves over and covers the front end portion of the handle lever 320 of the lever 300 and fixes the lever 300 when the device 400 for dual position confirmation is moved forward to the lever. The lever cover end 440 is formed at the rear portion of the body 410.

The lever cover end 440 and the locking bar 430 are spaced apart up and down in parallel with each other.

A process of fastening the connector assembly having a device for dual position confirmation having the configuration described above is described with reference to FIGS. 5-10.

Figure 5:
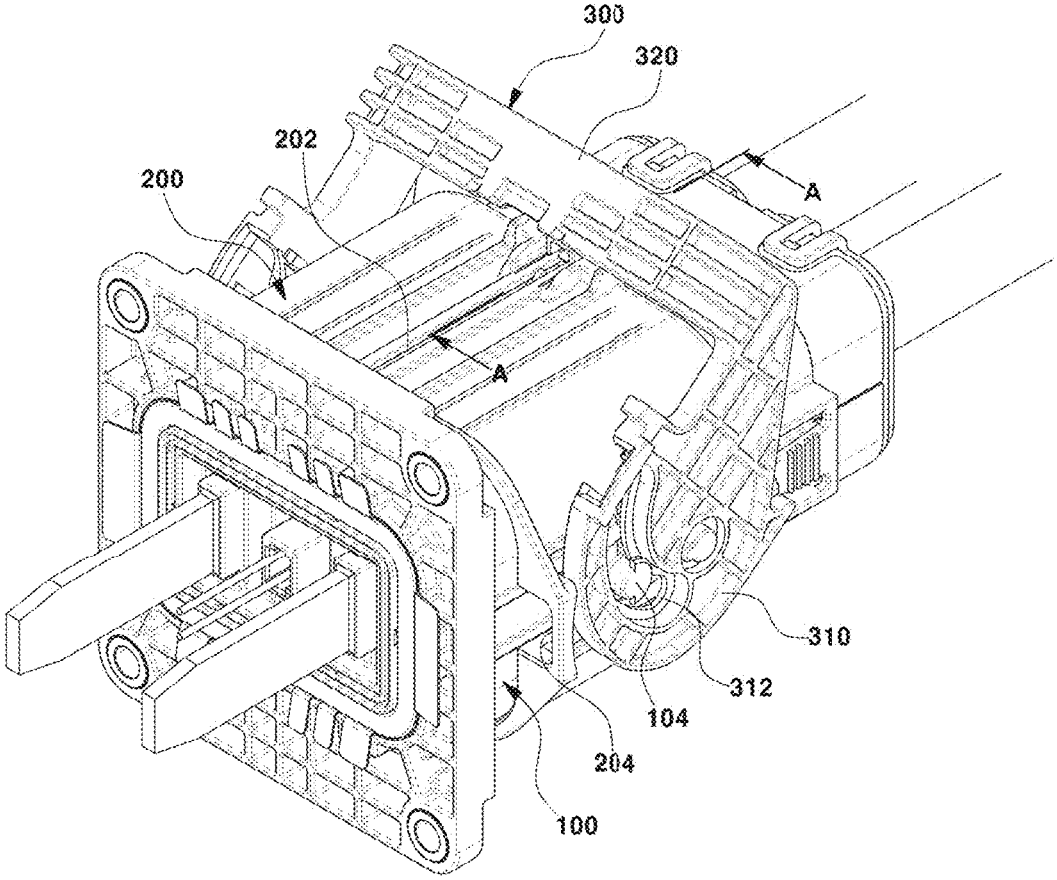
FIGS. 5-7 are perspective views sequentially showing a process of fastening a connector assembly having a device for dual position confirmation according to the present disclosure.

First, when the male connector 100 is inserted into the female connector 200, as shown in FIG. 5, the guide pins 104 of the male connector 100 are moved forward a predetermined distance through the second guide holes 204 of the female connector 200 and are inserted into the slots 412 formed at the rotary lever 310 of the lever 300.

Further, when the male connector 100 is inserted into the female connector 200, as shown in FIG. 8, the position confirmation protrusion 102 of the male connector 100 is moved forward a predetermined distance through the first guide hole 202 of the female connector 200 and is positioned at a predetermined distance from the hook 420 of the device 400 for dual position confirmation.

In this state, the hook 420 of the device 400 for dual position confirmation has been locked to the rear wall of the first guide hole 202.

Figure 6:
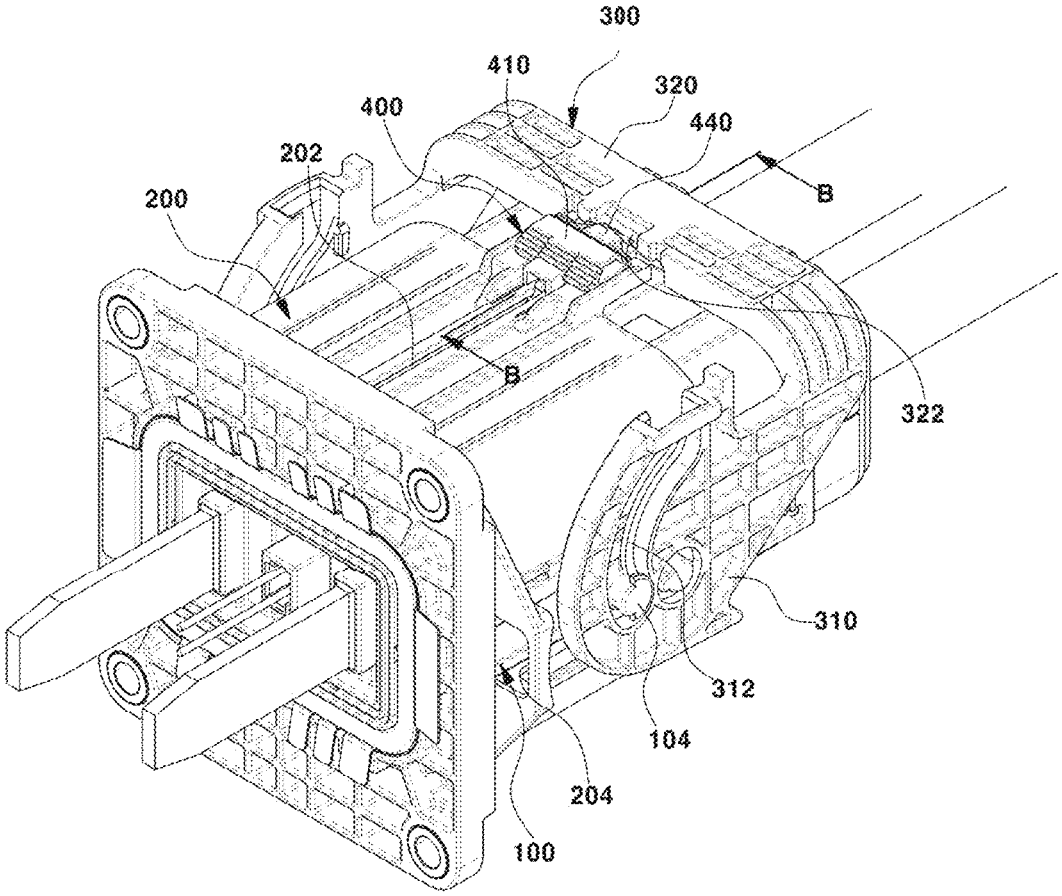
Figure 7:
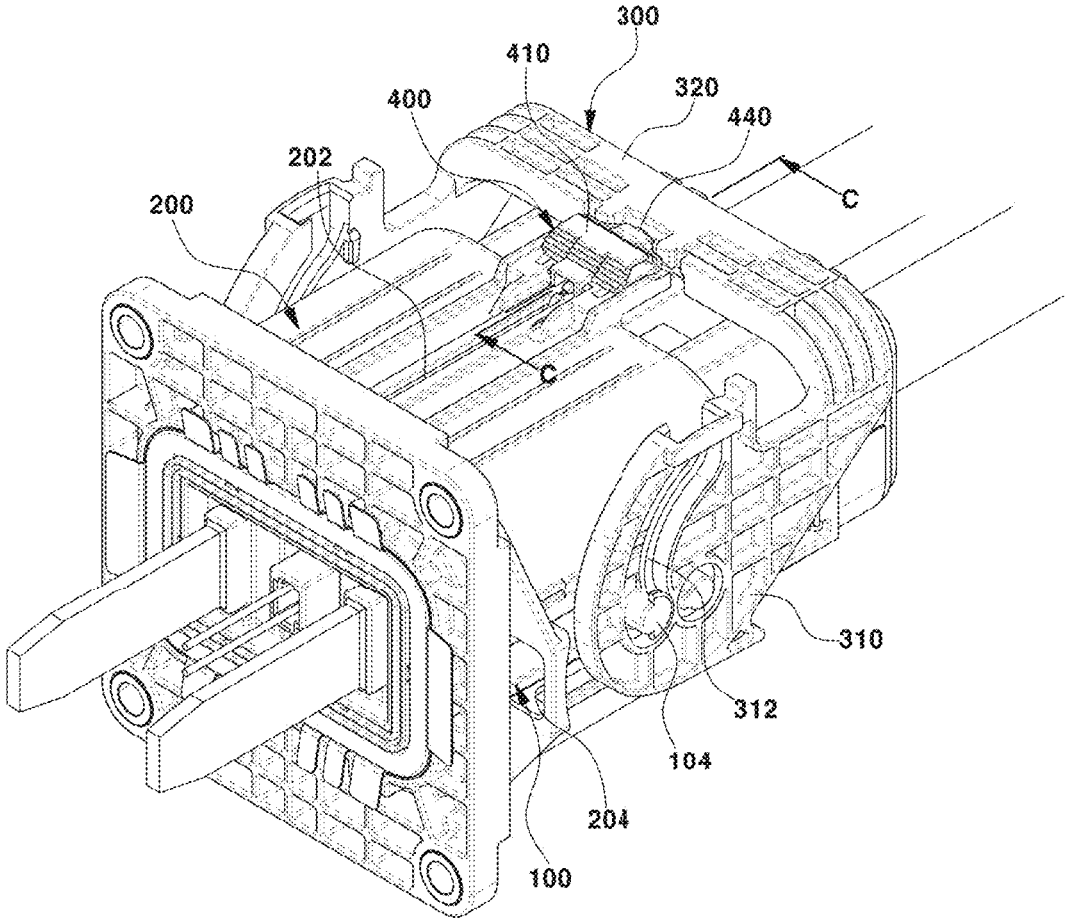

Next, when the handle lever 320 of the lever 300 is rotated backward beyond the device 400 for dual position confirmation, as shown in FIG. 6, the rotary levers 310 are also rotated backward.

When the rotary levers 310 are rotated, the guide pins 104 of the male connector 100, which inserted in the slots 312, are pulled inside the female connector, so the guide pins 104 are moved forward to the innermost positions of the second guide holes 204.

Further, the position confirmation protrusion 102 of the male connector 100, as shown in FIG. 9, moves to the innermost position of the first guide hole 202 of the female connector 200 and lifts the hook 420 of the device 400 for dual position confirmation, whereby the device 400 for dual position confirmation is tilted.

Accordingly, a user can recognize from the lifting motion of the hook 420 of the device 400 for dual position confirmation that the female connector and the male connector have been completely connected.

Next, the user holds the body 410 and pushes the device 400 for dual position confirmation toward the handle lever 320 of the lever 300.

Figure 10:
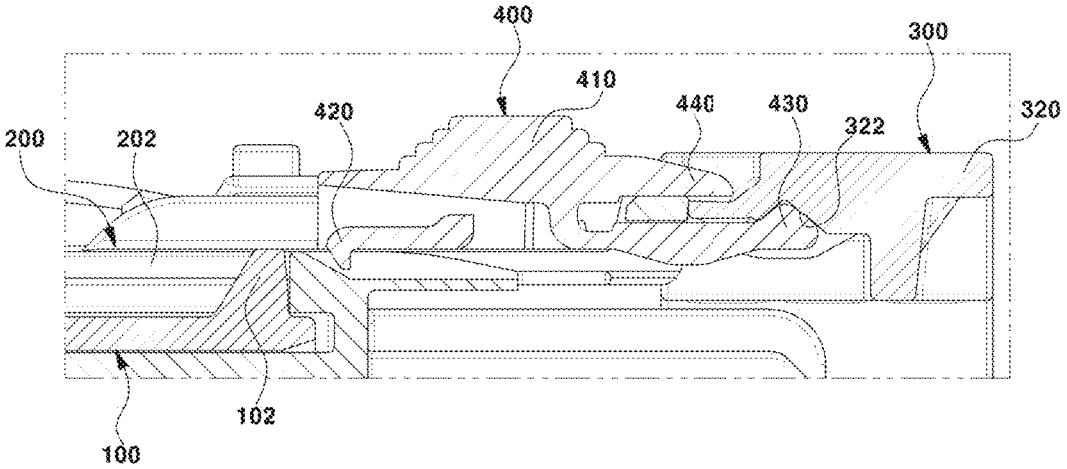
FIG. 10 is a cross-sectional view taken along line C-C shown in FIG. 7.

Accordingly, the locking bar 430 of the device 400 for dual position confirmation, as shown in FIG. 10, is inserted into the locking groove 322 of the handle lever 320, whereby the lever 300 is fixed by the lever cover 440.

Further, the lever cover end 440 of the device 400 for dual position confirmation, as shown in FIGS. 7-10, moves over and covers the front end portion of the handle lever 320 of the lever 300.

Accordingly, the user can recognize from the end of the lever cover 440 covering the front end portion of the handle lever 320 that the locking bar 430 of the device 400 for dual position confirmation has been inserted in the locking groove 322 of the handle lever 320 and the lever 300 has been fixed by the lever cover 440.

In other words, the user can recognize, from the state in which the lever cover end 440 of the device 400 for dual position confirmation covers the front end portion of the handle lever 320, that the locking bar 430 of the device 400 for dual position confirmation has been inserted in the locking groove 322 of the handle lever 320 and the lever 300 has been rotated and firmly fixed by the lever cover 440.

As described above, it is possible to dually check the fastening state and position of the male connector 100 and the female connector 200 and the fastening state and position of the lever 300 by the device 400 for dual position confirmation. Thus, it is possible to improve stability and quality of the connector assembly.

A process of unlocking the lever and unfastening the female and male connectors is described with reference to FIGS. 11-13.

Figure 11:
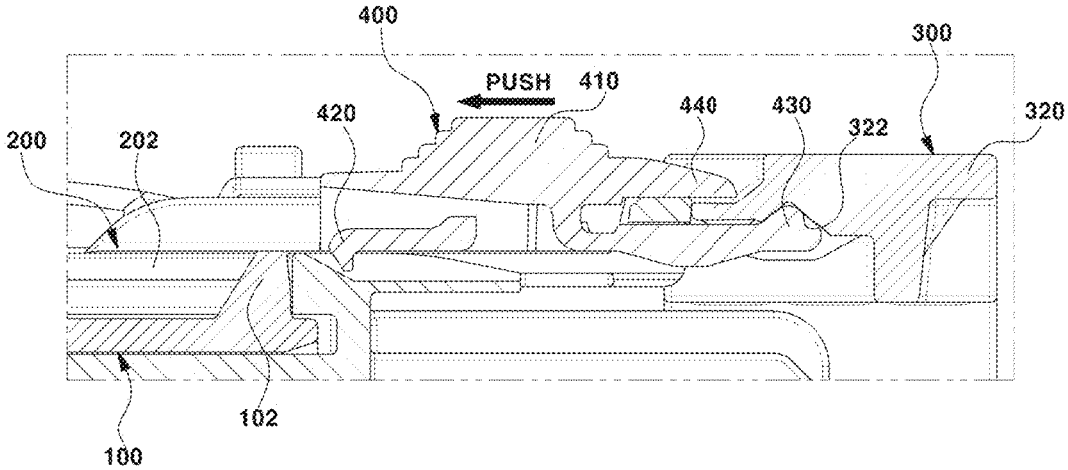
FIGS. 11-13 are cross-sectional views sequentially showing a process of unfastening the device for dual position confirmation according to the present disclosure.
Figure 12:
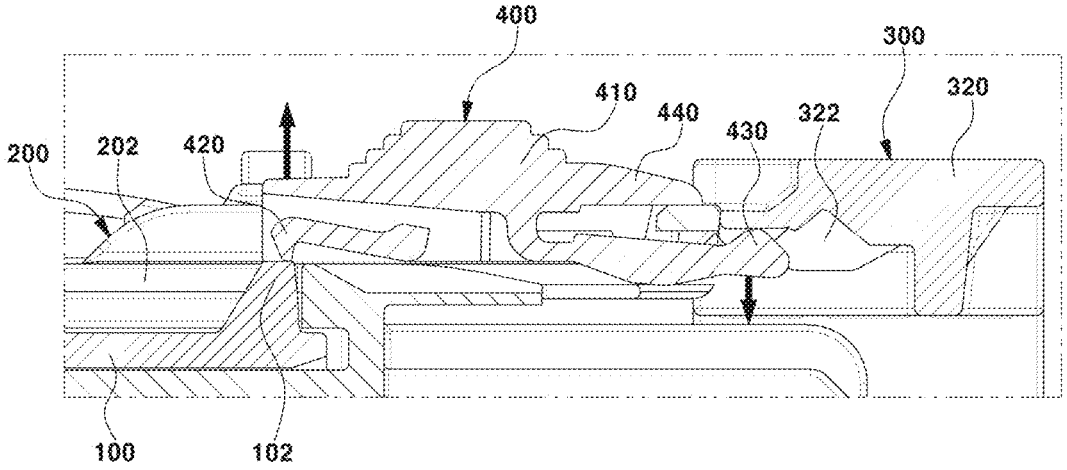

First, as shown in FIG. 11, when a user holds and moves backward the device 400 for dual position confirmation to unfasten the device 400 for dual position confirmation, the locking bar 430 of the device 400 for dual position confirmation is pulled out of the locking groove 322 of the handle lever 320.

Further, the hook 420 of the device 400 for dual position confirmation is moved onto the position confirmation protrusion 102 of the male connector 100. The front end of the device 400 for dual position confirmation is thereby tilted up, as shown in FIG. 12.

Next, the user pulls the male connector 100 out of the female connector 200, whereby the female and male connectors are separated.

Figure 13:
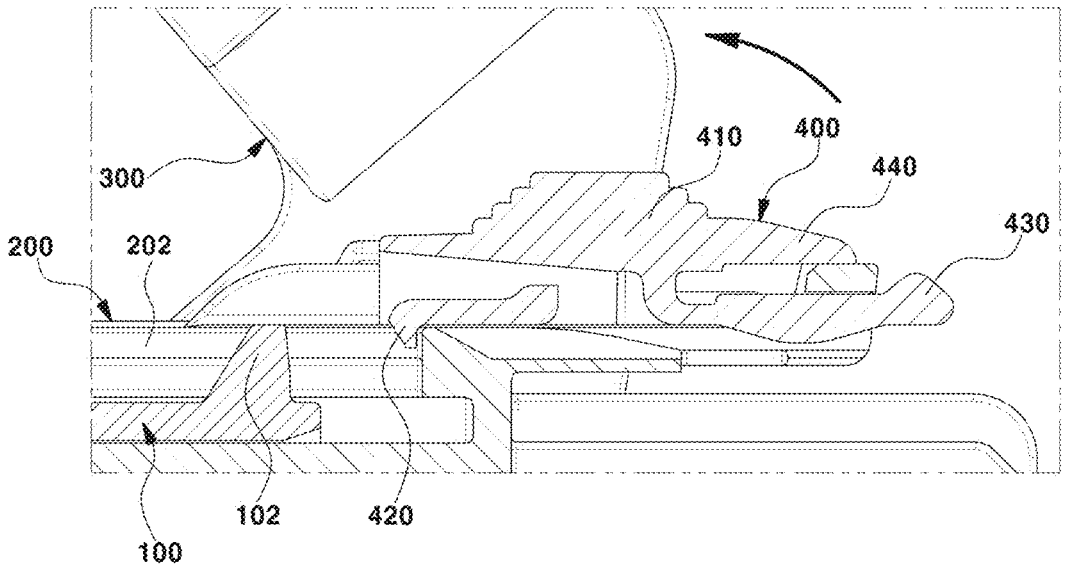

Accordingly, the hook 420 of the device 400 for dual position confirmation is moved down and locked to the rear wall of the first guide hole 202 of the female connector 200, as shown in FIG. 13. The user rotates forward the lever 300 to the initial position.

If the device 400 for dual position confirmation is not moved even though the user applies a force of a predetermined level or more to the device 400 for dual position confirmation, the locking bar 430 of the device 400 for dual position confirmation may not be fully inserted in the locking groove 322 of the handle lever 320 and may not be pulled out of the locking groove 322.

Accordingly, the force for inserting and separating the locking bar 430 of the device 400 for dual position confirmation into and out of the locking groove 322 of the handle lever 320 should be set as 2.0 kgf or less.

Accordingly, the user can easily insert the locking bar 430 of the device 400 for dual position confirmation into the locking groove 322 of the handle lever 320 and can easily pull the locking bar 430 out of the locking groove 322.

As described above, it is possible to dually check the fastening state and position of the female and male connectors and the fastening state and position of the lever 300 by the device 400 for dual position confirmation. Thus, it is possible to improve stability and quality of the connector assembly.

What is claimed is:

1. A connector assembly having a device for dual position confirmation, the connector assembly comprising:

a male connector having a position confirmation protrusion formed at the front end of a top thereof and having guide pins protruding from both sides thereof;

a female connector having a first guide hole on a top thereof in which the position confirmation protrusion is inserted to be able to move straight and having second guide holes on both sides thereof in which the guide pins are inserted to be able to move straight;

a device for dual position confirmation fastened to a rail formed behind the first guide hole to be able to be tilted and moved straight; and a lever configured to move forward and backward the guide pins in the second guide holes, and the lever having rotary levers fastened to both sides of the female connector and a handle lever having a locking groove for fastening with the device for dual position confirmation and integrally formed with the rotary lever.

2. The connector assembly of claim 1, wherein the device for dual position confirmation includes:

a body configured to be pushed and moved straight;

a hook formed on a bottom of a front portion of the body and configured to be locked to a rear wall of the first guide hole of the female connector to be able to move up; and a locking bar formed on a bottom of a rear portion of the body and configured to be separably inserted in the locking groove of the lever.

3. The connector assembly of claim 2, wherein an empty space for absorbing push pressure is formed in the body.

4. The connector assembly of claim 2, wherein step-shaped wrinkles are formed forward and backward from a top of the body for easy operation for straight moving.

5. The connector assembly of claim 2, wherein a lever cover end is configured to move over and cover a front end portion of the handle lever and is formed at a rear portion of the body.

6. The connector assembly of claim 1, wherein slots are formed at the rotary levers of the lever, the guide pins, which protrude through the second guide holes, are received by the slots, and wherein the slots are curved to straightly move the guide pins in the second guide holes when the rotary levers are rotated.

7. The connector assembly of claim 2, wherein, when the position confirmation protrusion of the male connector is inserted up to the rear wall of the first guide hole and presses the hook with the hook of the device for dual position confirmation locked to the rear wall of the first guide hole of the female connector, the hook is moved up and unlocked.

8. The connector assembly of claim 7, wherein, after the hook is moved up and unlocked, when the body of the device for dual position confirmation is pushed toward the lever, the locking bar is inserted and locked in the locking groove of the lever.

9. The connector assembly of claim 8, wherein, when the locking bar is inserted into the locking groove of the lever, a lever cover end of the device for dual position confirmation moves over and covers a front end portion of the handle lever.

10. The connector assembly of claim 2, wherein an insertion force when the locking bar is inserted into the locking groove of the lever is set as 2.0 kgf or less.

* * * * *